US010014631B1

(12) United States Patent
Chambly et al.

(10) Patent No.: US 10,014,631 B1
(45) Date of Patent: Jul. 3, 2018

(54) SECURE ELECTRICAL CONDUCTOR CONNECTOR

(71) Applicants: Lawrence R Chambly, Winnsboro, TX (US); Brett A. Miller, Winnsboro, TX (US)

(72) Inventors: Lawrence R Chambly, Winnsboro, TX (US); Brett A. Miller, Winnsboro, TX (US)

( * ) Notice: Subject to any disclaimer, the term of this patent is extended or adjusted under 35 U.S.C. 154(b) by 0 days.

(21) Appl. No.: 15/732,245

(22) Filed: Oct. 12, 2017

(51) Int. Cl.
*H01R 13/62* (2006.01)
*H01R 13/639* (2006.01)
*H01R 13/641* (2006.01)
*H01R 13/6581* (2011.01)

(52) U.S. Cl.
CPC ..... *H01R 13/639* (2013.01); *H01R 13/641* (2013.01); *H01R 13/6581* (2013.01)

(58) Field of Classification Search
CPC ..... H01R 13/625; H01R 13/639; H01R 13/6278; H01R 13/641; H01R 13/6581; H01R 25/003; B60R 16/005
See application file for complete search history.

(56) References Cited

U.S. PATENT DOCUMENTS

| | | | | |
|---|---|---|---|---|
| 2,046,221 | A * | 6/1936 | Thomas | H01R 13/625 337/187 |
| 3,760,332 | A | 9/1973 | Berkovits | |
| 4,148,538 | A * | 4/1979 | Rodondi | H01R 13/6278 439/347 |
| 4,842,524 | A * | 6/1989 | Hopkins | H01R 25/003 439/34 |
| 5,248,259 | A * | 9/1993 | Naito | B60R 16/005 439/188 |
| 6,319,039 | B1 | 11/2001 | Chambly | |
| 7,108,533 | B2 | 9/2006 | Howard | |
| 7,722,377 | B2 | 5/2010 | Moore | |

* cited by examiner

*Primary Examiner* — Jean F Duverne
(74) *Attorney, Agent, or Firm* — Randall D. Homburg

(57) ABSTRACT

An improved secure electrical conductor providing a male and female connector forming a secure seal when the connectors and pins are joined having at least one radial rounded expansion secured within at least one radial rounded groove, the connectors forming a respective resilient shield body sharing a common bore wherein a distinctly color contrasting secure indicator pin is forcefully inserted providing a visual indication of the integrity of the connection between the connectors with the pin providing at least two expanded radial margins to prevent unintentional removal from the common bore, but removable by force during disconnection of the connectors.

8 Claims, 3 Drawing Sheets

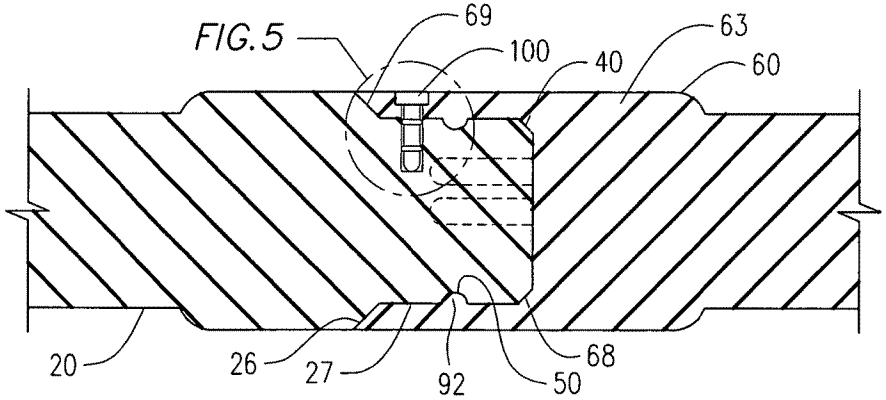
FIG. 5
FIG. 4
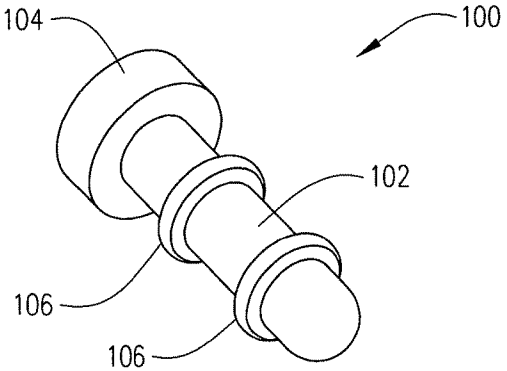
FIG. 5
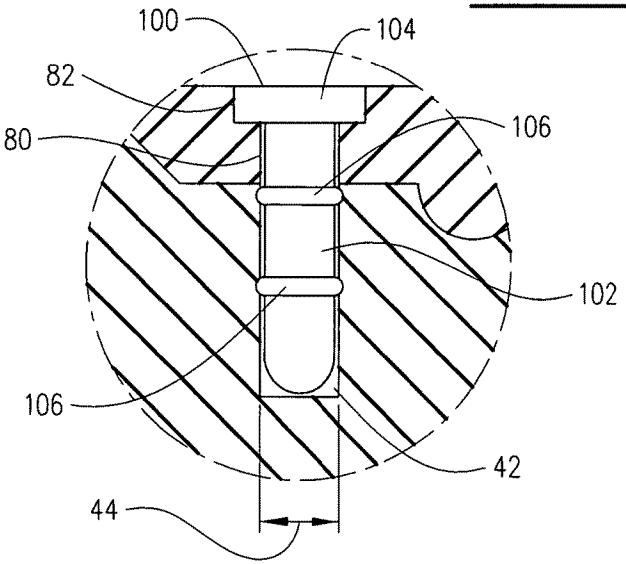
FIG. 5

SECURE ELECTRICAL CONDUCTOR CONNECTOR

CROSS REFERENCE TO RELATED APPLICATIONS

None.

BACKGROUND OF THE INVENTION

1. Field of Invention

An improved secure electrical conductor connector providing a male and female connector forming a secure seal, the connectors forming a common bore providing a visual indication of the integrity of the connection between the connectors.

2. Description of Prior Art

A preliminary review of prior art patents was conducted by the applicant which reveal prior art patents in a similar field or having similar use. However, the prior art inventions do not disclose the same or similar elements as the present improved electrical connectors, nor do they present the material components in a manner contemplated or anticipated in the prior art.

In U.S. Pat. No. 6,319,039 to Chambly (present first named inventor) a secure connector was disclosed which had a first conductor containing body having a receptacle opening defining a first seal-enhancing fitting around the inside of the receptacle opening, a second conductor containing body that fit within the first conductor with a second seal enhancing fitting that formed a water proof seal with the first seal-enhancing fitting, and alignment bores in each conductor with a removable pin inserted within the alignment bores with a contracting color between the pin and the connector bodies for visual confirmation of a secure connection. The present invention is an improvement to that particular electrical connector, having a distinct connector pin which inhibits accidental removal of the connector pin and a distinctly different seal between the first and second conductor containing bodies forming an improved water resistant seal.

SUMMARY OF THE INVENTION

Electrical connectors are provided for various residential and commercial applications. Some are simple two prong plugs that fit within a simple two prong receptacle, including most household current plugs. Other are provided with unique and novel pin patterns and receivers unique to the pin connection for low voltage, such as computer current connectors and automotive electrical connectors. Some are suited for industrial currents of high voltage and current.

The present field of electrical connectors are for outdoor connectors, primarily associated with vehicle connections, where the connectors are exposed to adverse weather conditions, exposure to dirt and mud, and in locations where frequent operation with commercial application, combat conditions, off-road operation and hostile terrains are possible.

The present electrical connectors form a male and a female plug, most frequently with multiple pin and receiver connections commonly used in trailer hook-ups or under chassis vehicular connectors. These connector usually provide a formed male connector defining a formed extension which is inserted within a formed female receptacle, with the pins and connector holes aligned and engaged while the rubber or other polymeric connector portions engage one another forming some type of water and element resistant seal to hold the pins and holes together during engagement.

The primary objective of the present invention is to provide an improvement to the seal between the male and female connector bodies with an improved secure locking pin engaging a common bore within the male and female connector bodies that provides a visual confirmation of a secure seal between the male and female connector bodies that can only be removed by an intentional force. A secondary objective is to provide the improved pin with a distinct color contrast with the connector bodies providing for quick inspection of the electrical connection, the pin being of a distinctly contrasting color (white/black, yellow/black, red/black, etc.) to that of the connector bodies.

DESCRIPTION OF THE DRAWINGS

The following drawings are submitted with this utility patent application.

FIG. 2 is a cross-sectional view of a second embodiment of the secure electrical conductor connector with the radial rounded expansion ring within the socket sleeve and the rounded groove on the outer surface of the plug insert.

FIG. 3 is a cross-sectional view of the first embodiment of the secure electrical conductor connector with the radial rounded expansion on the outer surface of the plug insert and the rounded groove within the socket sleeve.

FIG. 6 is a perspective view of the secure connection pin.

DESCRIPTION OF THE PREFERRED EMBODIMENT

Figure 1:
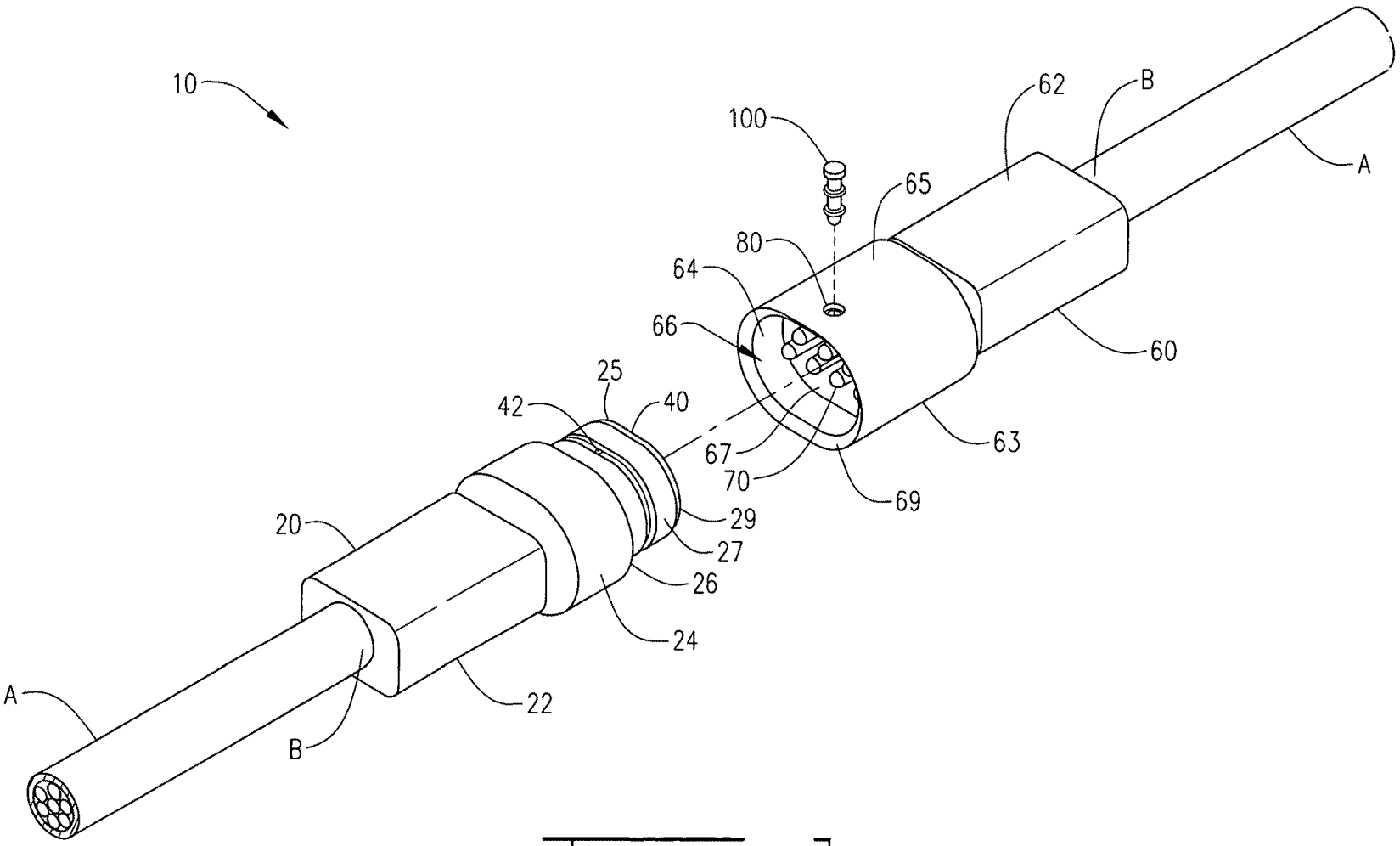
FIG. 1 is a perspective view of a first embodiment of the secure electrical conductor connector.

A secure electrical conductor connector 10, for the connection of electrical wiring as shown in FIGS. 1-6, comprises an electrical plug 20 formed on the end B of an insulated wire bundle A, an electrical socket 60 formed on the end B of another insulated wire bundle A, and a high contrast colored connection pin 100, the secure electrical conductor connector 10 establishing a removable and attaching connection between the insulated wire bundles A. This connection establishes a weatherproof secure connection, primarily used in motor vehicles and other transportation devices, including airplanes, boats and naval vessels, heavy machinery, construction equipment, utility trailers and other apparatus which are used outdoors and transporting electrical current with two or more wire connections.

The electrical plug 20 further comprises a formed base 22, an extended collar 24 and shaped plug end 27 defining an outer surface 28 and a terminal face 29. The shaped plug end 27 may be rounded, oval, elliptical, square other geometric shape. Embedded within the terminal face 29 of the shaped plug end 27 are two or more bayonet sleeves 30, respectively connected to at least one wire within the insulated wire bundle A, which extends from the insulated wire bundle A through the electrical plug 20, with each bayonet sleeve 30 open towards the terminal face 29. The terminal face 29 provides a radial bevel 40 between the outer surface 28 of the shaped plug end 27 and the terminal face 29, FIGS. 2-4. On the outer surface 28 of the shaped plug end 27, there is one or more surface enhancements which provide a first element of the secure connection between the electrical plug 20 and the electrical socket 60 in the form of either a rounded radial groove 50 or a round radial expansion 52, depending on a mating surface enhancement of the electrical socket 60, FIGS. 1-5. Additionally, a radial bore 42 is defined within the shaped plug end 27, the radial bore 42 avoiding any impingement upon any of the embedded bayonet sleeves 30, FIGS. 2-5. On the extended collar 24 of the electrical plug 20, a sloped terminal margin 26 is presented at an edge 25 directed towards the shaped plug end 27, FIGS. 2-4.

The electrical socket 60 further comprises a formed base 62, an outer resilient collar 63 having an internal surface 64 and an external surface 65 and forming a socket opening 66 extending into a socket base 67, FIGS. 1-4. The outer resilient collar 63 and socket opening 66 form an internal profile which can be rounded, oval, elliptical, square or other geometric shape conforming in size and shape to that of the shaped plug end 27 of the mating electrical plug 20. Extending from the socket base 67 are a plurality of bayonet conductors 70 which are respectively connected to at least one wire within the insulated wire bundle A, which extends from the insulated wire bundle A through the electrical socket 60, with each bayonet conductor 70 extending outward towards the socket opening 66, FIGS. 2-4. Each bayonet conductor 70 is oriented in size and shape to be inserted within a corresponding bayonet sleeve 30 within the electrical plug 20 when the electrical plug 20 and electrical socket 60 are engaged, forming a secure electrical connection between the insulated wire bundle A of the electrical plug 20 and the insulated wire bundle A of the electrical socket 60, completing the electrical wire connection, FIGS. 2-4.

Figure 4:
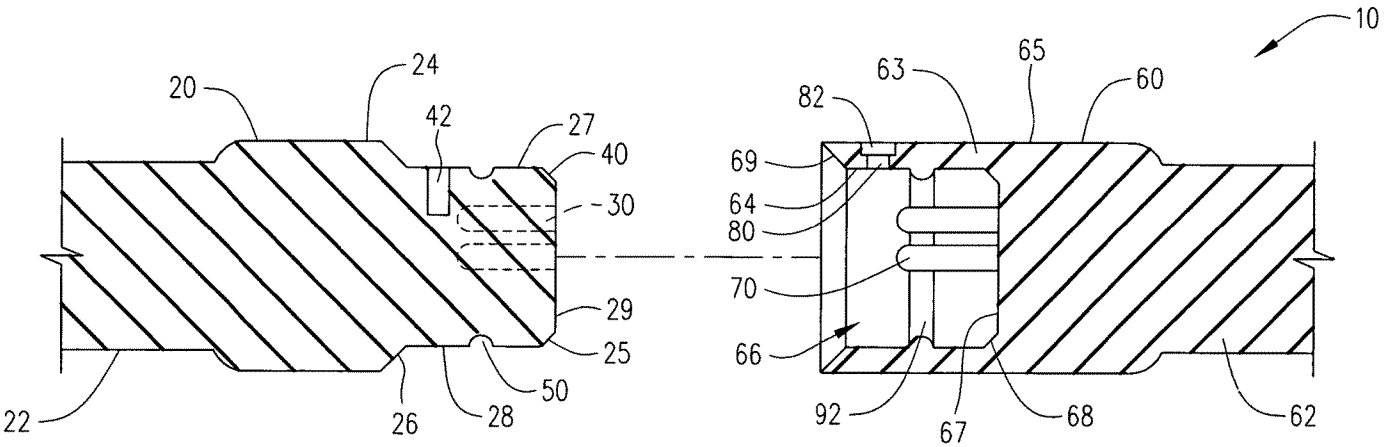
FIG. 4 is a cross-sectional view of the first embodiment in an assembled connection with the secure connection pin inserted in the aligned bores of the sleeve and the plug insert.

Between the internal surface 64 of the outer resilient collar 63 and the socket base 67, there is a beveled shoulder 68 confirming in shape and angle to the radial bevel 40 around the terminal face 29 of the shaped plug end 27 of the electrical plug 20, FIGS. 2-4. On the internal surface 64 of the outer resilient collar 63, there is one or more surface enhancements which provide a second element of the secure connection between the electrical socket 60 and the electrical plug 20 in the form of either a rounded radial groove 90 or a round radial expansion 92, depending on the mating surface enhancement of the electrical plug 20. The enhancements of the electrical plug 20 and electrical socket 60 are located so that upon connection of the electrical plug 20 and the electrical socket 60, at least one rounded radial groove 50, 90, receives and engages at least one on round radial extension 52, 92, which not only secures the electrical plug 20 within the electrical socket 60, but also acts as one of several weather-tight fittings which prevent intrusion of water and contaminants to the bayonet sleeve 30 and bayonet conductors 70 within the secure electrical conductor connector 10, FIG. 4, with each rounded radial groove receiving each round radial extension with complete, equal and conforming profiles.

FIG. 3 is a cross-sectional view of a first embodiment of the secure electrical conductor connector 10 with a round radial expansion 52 on the outer surface 28 of the shaped plug end 27 and the rounded radial groove 90 within the outer resilient collar 63. FIG. 2 is a cross-sectional view of a second embodiment of the secure electrical conductor connector 10 with the round radial expansion 92 within the outer resilient collar 63 and the rounded radial groove 50 on the outer surface 28 of the shaped plug end 27. FIG. 4 is a cross-sectional view of the first embodiment in an assembled connection with the secured connection pin 100 inserted in the aligned radial bores 42, 80, of the outer resilient collar 63 and the shaped plug end 27. FIG. 1 is a perspective view of the first embodiment of the secure electrical conductor connector 10 indicating the respective insulated wire bundles A.

Figure 5:
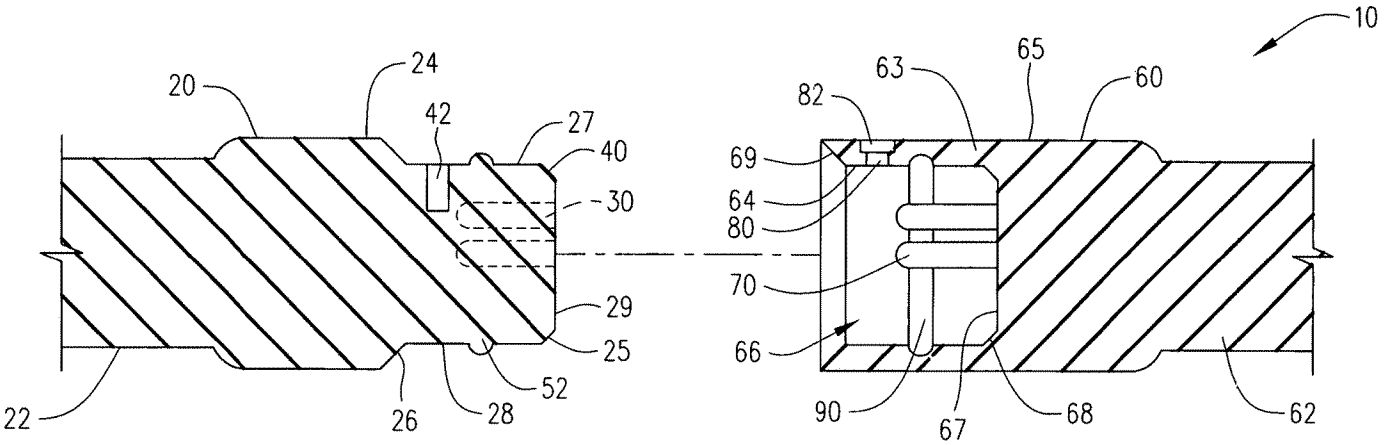
FIG. 5 is an isolation view of the secure connection pin inserted in the aligned bores of the sleeve and the plug insert, as indicated in FIG. 4.

The radial bore 80 is defined through the outer resilient collar 63 from the external surface 65 to the internal surface 64, aligning radially with the radial bore 42 of the electrical plug 20 during assembly, with the high contrast connection pin 100 inserting through the radial bore 80 of the electrical socket 60 into the radial bore 42 of the electrical plug 20 subsequent to connection of the electrical plug 20 and the electrical socket 60, FIGS. 4-5. At the socket opening 66 of the outer resilient collar 63, a reversed sloped terminal margin 69, conforming in size and slope to that of the sloped terminal margin 26 of the extended collar 24 of the electrical plug 20 but reversed in slope. This reversed sloped terminal margin 69 of the outer resilient collar 63 is presented to provide a secure conforming engagement with the sloped terminal margin 26 of the extended collar 24 of the electrical plug 20 when the electrical plug 20 and electrical socket 60 are engaged.

As defined herein, there are numerous preventative measures contained within the secure electrical conductor connector 10, FIG. 4. First is the aforementioned one or more engagements of the surface enhancements within the electrical plug 20 and electrical socket 60. Second, the engagement between the reversed sloped terminal margin 69 of the outer resilient collar 63 and the sloped terminal margin 26 of the extended collar 24 of the electrical plug 20, which creates a conforming seal between the electrical plug 20 and the electrical socket 60. Third, the profile, size and shape of the shaped plug end 27 of the electrical plug 20 conforms to the profile, size and shape of the outer resilient collar 63 of the electrical socket 60, in such close proximity to prevent intrusion of water or contaminants, so much so that a lubricant may be useful in the connection process. Any and all of these preventative measures ensure that no outer elements can penetrate the seals created between the electrical plug 20 and the electrical socket 60 during secure connection. Additionally, the radial bevel 40 on the shaped plug end 27 when passing through the reversed sloped terminal margin 69 of the outer resilient collar 63 provides for easier insertion of the shaped plug end 27 of the electrical plug 20 into the outer resilient collar 63 of the electrical socket 60. As previously mentioned, an inert lubricant may be recommended applied to the internal surface 64 of the outer resilient collar 63 and/or the outer surface 28 of the shaped plug end 27, especially during an initial connection of the electrical plug 20 into the electrical socket 60. This lubricant, not shown, is also a preventative measure to prevent intrusion of water or contaminants within the assembled electrical plug 20 and electrical socket 60.

Once the connection of the electrical socket 60 and electrical plug 20 have been established, the high contract colored connection pin 100, FIG. 6, is inserted through the radial bore 80 of the outer resilient collar 63 into the aligned radial bore 42 of the shaped plug end 27, FIGS. 4-5. In this regard the connection pin 100 defines a pin shaft 102, a pin head 104 and at least two radial expansion rings 106 along the pin shaft 102, as shown in FIGS. 4 and 6. The placement of the at least two radial expansion rings 106 is not random. The radial expansion ring 106 closest to the pin head 104 is located along the pin shaft 102 where when fully secured within the aligned radial bores 42, 80, this radial expansion ring 106 is positioned immediately below the internal surface 64 of the outer resilient collar 63, while the other existing radial expansion ring 106 is forcibly placed within the radial bore 42 of the shaped plug end 27, with each radial expanded ring 106 being greater in width than the inner diameter 44 of the radial bore 42 of the shaped plug end 27, FIG. 5. In furtherance of the placement of the connection pin 100, a pin head expansion 82 may be located in the radial bore 80 within the external surface 65 of the outer resilient collar 63, as shown in FIGS. 4 and 6, to limit the insertion of the connection pin 100 within the aligned radial bores 42, 80, to exact location of the radial expansion rings 106 to their intended location.

While the primary inclusion of the high contrast colored connection pin 100 is to secure the aligned radial bores 42, 80, a secondary objective is to provide the pin 100 with a distinct color contrast with the electrical plug 20 and electrical socket 60 providing for quick inspection of the electrical connection, the pin 100 being of a distinctly contrasting color (white/black, yellow/black, red/black, etc.) to the color of the electrical socket 60 and electrical plug 20. This connection pin 100 is easily recognized during a cursory inspection of the secure electrical conductor connector 10 to visually confirm that the electrical plug 20 is securely connected within the electrical socket 60. If the pin is missing or not seen, then there is a visual alert that the electrical plug 20 and electrical socket 60 may not be secure or subject to intrusion of water or contaminating elements. If the pin 100 is present upon a visual inspection, there is immediate confirmation that the electrical plug 20 and electrical socket 60 are properly connected. Removal of the connection pin 100 should require intentional force and removal should be done prior to disconnection of the electrical plug 20 from the electrical socket 60 to prevent damage to the respective radial bores 42, 80, of the electrical plug 20 and especially the electrical socket 60.

Alignment of the respective radial bores 42, 80, should require no effort due to the conforming shapes of the shaped plug end 27 and the internal surface 64 of the outer resilient collar 63 plus the alignment and integration of the bayonet sleeves 30 and the bayonet conductors 70, which are oriented in mirror image alignment and should only be connected with the electrical plug 20 and the electrical socket 60 in a singular position. Thus, the radial bores 42, 80, should be aligned any time the electrical plug 20 and electrical socket 60 are fully engaged. If they are not, an immediate connection problem should be noticed and connection should be attempted again. The number of bayonet conductors 70 and bayonet sleeves 30 should be aligned and purposeful, but not necessarily equal. It is known in the industry that there are examples of more sleeves 30 being included in electrical plugs than bayonet conductors 70 in certain cases where the plug is connected to fewer wires than the socket. However, it is not possible that the number of bayonet conductors 70 exceed the number of bayonet sleeves 30, which should be practically recognized by those skilled in the art of electrical connectors, because one cannot connect and plug and socket with fewer sleeves than conductors.

Preferred materials for the components of the electrical plug 20 and electrical socket 60 are a resilient rubber or polymeric plastic, with the outer resilient collar 63 and the portion of the shaped plug end 27 providing the radial bores 42, 80, being resilient and momentarily deformable. The preferred material for the high contrast colored connection pin 100 is plastic or polypropylene. The required material for the bayonet sleeve 30 and the bayonet conductors 70 is a conductive metal, which are either soldered, welded or otherwise engaged with the respective metal wires (not shown) contained within the insulated wire bundles A.

While the secure electrical conductor connector 10 has been particularly shown and described with reference to a preferred embodiment thereof, it will be understood by those skilled in the art that changes in form and detail may be made therein without departing from the spirit and scope of the invention.

What is claimed is:

1. A secure electrical conductor connector establishing a weatherproof and secure connection transporting electrical current between two or more wire connections within attached insulated wire bundles, the secure electrical conductor connector comprising:

an electrical plug defining a formed base integrated with an end of an insulated wire bundle, said formed base defining a shaped plug end with an outer surface and a terminal face providing two or more imbedded bayonet sleeves, each conductive bayonet sleeve attaching to at least one respective wire within said insulated wire bundle, with said outer surface of said shaped plug end defining at least one radial rounded groove and a radial bore, said formed base defining an extended collar having a sloped terminal margin, and a radial bevel formed on an edge defined between said terminal face and said outer surface;

an electrical socket defining a formed base integrated with an end of an insulated wire bundle, said formed base defining an outer resilient collar having an internal surface and an external surface, said outer resilient collar further defining a socket opening and a socket base with a beveled shoulder formed between said socket base and said internal surface within said socket opening, said formed base defining a reversed sloped terminal margin, said socket base extending two or more bayonet conductors directed towards said socket opening, said internal surface of said outer resilient collar defining at least one round radial expansion and a radial bore defined within said outer resilient collar from said external surface through said internal surface; and a colored connection pin defining a pin head and a shaft extending two or more radial expansion rings, wherein said shaped plug end of said electrical plug is installed within said outer resilient collar of said electrical socket with each said bayonet conductor of said electrical socket securely inserting within a respective aligned bayonet sleeve of said electrical plug until said terminal face of said electrical plug is against said socket base of said electrical socket, forming a conductive connection between said insulated wire bundles, forming a engaging seal between said radial rounded groove of said electrical plug receiving said round radial expansion of said electrical socket with each said at least one rounded radial groove and each said at least one round radial extension defining equal and conforming profiles, forming an inner seal between said beveled shoulder of said electrical socket and said radial bevel of said electrical plug, and forming an outer seal between said sloped terminal margin of said electrical plug and said reversed sloped terminal margin of said electrical socket, wherein said respective radial bores of said connected electrical socket and said electrical plug are aligned to receive said shaft of said connection pin forcing said at least two radial expansion rings of said shaft into said radial bore, providing a visual indication of a secure connection between said electrical plug and said electrical socket.

2. The secure electrical conductor connector of claim 1, further comprising:

said outer resilient collar and said radial bore defining a pin head expansion within said external surface wherein said pin head of said connection pin is inserted flush with said external surface of said outer resilient collar upon insertion of said connection pin; and said connection pin is a high contrast color, visually distinct from said outer resilient collar of said electrical socket, wherein the presence of said installed connection pin is distinctly visible within said outer resilient collar.

3. The secure electrical conductor connector of claim 1, further comprising:

said resilient materials of said electrical plug and electrical socket are selected from a group consisting of a resilient rubber or resilient polymeric plastic, including said outer resilient collar and the portion of the shaped plug end providing said radial bores being momentarily deformable;

said material of said colored connection pin is selected from a group consisting of plastic or polypropylene which is not deformable; and said material of said two or more bayonet sleeve and said two or more bayonet conductors is a conductive metal, wherein each said two or more bayonet sleeves and said two or more bayonet conductors are independently and respectively soldered, welded or otherwise affixed upon each said respective metal wire contained within said respective insulated wire bundles.

4. The secure electrical conductor connector of claim 1, further comprising:

said outer resilient collar and said radial bore defining a pin head expansion within said external surface wherein said pin head of said connection pin is inserted flush with said external surface of said outer resilient collar upon full insertion of said connection pin, wherein one of said at least two radial expansion rings closest to said pin head is located along said pin shaft is positioned immediately below said internal surface of said outer resilient collar and said other of said at least two radial expansion rings is forcibly placed within said radial bore of said shaped plug end, each said at least two radial expansion rings extending wider than an inner diameter of said radial bore of said shaped plug end.

5. A secure electrical conductor connector establishing a weatherproof and secure connection transporting electrical current between two or more wire connections within attached insulated wire bundles, the secure electrical conductor connector comprising:

an electrical plug defining a formed base integrated with an end of an insulated wire bundle, said formed base defining a shaped plug end with an outer surface and a terminal face providing two or more imbedded bayonet sleeves, each conductive bayonet sleeve attaching to at least one respective wire within said insulated wire bundle, with said outer surface of said shaped plug end defining at least one round radial expansion and d a radial bore, said formed base defining an extended collar having a sloped terminal margin, and a radial bevel formed on an edge defined between said terminal face and said outer surface;

an electrical socket defining a formed base integrated with an end of an insulated wire bundle, said formed base defining an outer resilient collar having an internal surface and an external surface, said outer resilient collar further defining a socket opening and a socket base with a beveled shoulder formed between said socket base and said internal surface within said socket opening, said formed base defining a reversed sloped terminal margin, said socket base extending two or more bayonet conductors directed towards said socket opening, said internal surface of said outer resilient collar defining at least one radial rounded groove and a radial bore defined within said outer resilient collar from said external surface through said internal surface; and a colored connection pin defining a pin head and a shaft extending two or more radial expansion rings, wherein said shaped plug end of said electrical plug is installed within said outer resilient collar of said electrical socket with each said bayonet conductor of said electrical socket securely inserting within a respective aligned bayonet sleeve of said electrical plug until said terminal face of said electrical plug is against said socket base of said electrical socket, forming a conductive connection between said insulated wire bundles, forming a engaging seal between said radial rounded groove of said electrical plug receiving said round radial expansion of said electrical socket with each said at least one rounded radial groove and each said at least one round radial extension defining equal and conforming profiles, forming an inner seal between said beveled shoulder of said electrical socket and said radial bevel of said electrical plug, and forming an outer seal between said sloped terminal margin of said electrical plug and said reversed sloped terminal margin of said electrical socket, wherein said respective radial bores of said connected electrical socket and said electrical plug are aligned to receive said shaft of said connection pin forcing said at least two radial expansion rings of said shaft into said radial bore, providing a visual indication of a secure connection between said electrical plug and said electrical socket.

6. The secure electrical conductor connector of claim 5, further comprising:

said outer resilient collar and said radial bore defining a pin head expansion within said external surface wherein said pin head of said connection pin is inserted flush with said external surface of said outer resilient collar upon insertion of said connection pin; and said connection pin is a high contrast color, visually distinct from said outer resilient collar of said electrical socket, wherein the presence of said installed connection pin is distinctly visible within said outer resilient collar.

7. The secure electrical conductor connector of claim 5, further comprising:

said resilient materials of said electrical plug and electrical socket are selected from a group consisting of a resilient rubber or resilient polymeric plastic, including said outer resilient collar and the portion of the shaped plug end providing said radial bores being momentarily deformable;

said material of said colored connection pin is selected from a group consisting of plastic or polypropylene which is not deformable; and said material of said two or more bayonet sleeve and said two or more bayonet conductors is a conductive metal, wherein each said two or more bayonet sleeves and said two or more bayonet conductors are independently and respectively soldered, welded or otherwise affixed upon each said respective metal wire contained within said respective insulated wire bundles.

8. The secure electrical conductor connector of claim 5, further comprising:

said outer resilient collar and said radial bore defining a pin head expansion within said external surface wherein said pin head of said connection pin is inserted flush with said external surface of said outer resilient collar upon full insertion of said connection pin, wherein one of said at least two radial expansion rings closest to said pin head is located along said pin shaft is positioned immediately below said internal surface of said outer resilient collar and said other of said at least two radial expansion rings is forcibly placed within said radial bore of said shaped plug end, each said at least two radial expansion rings extending wider than an inner diameter of said radial bore of said shaped plug end.

* * * * *